US011849842B2

(12) United States Patent
Xu et al.

(10) Patent No.: US 11,849,842 B2
(45) Date of Patent: Dec. 26, 2023

(54) MULTIFUNCTIONAL HAND CONTROLLER FOR HEIGHT-ADJUSTABLE FURNITURE

(71) Applicant: ZHEJIANG JIECANG LINEAR MOTION TECHNOLOGY CO., LTD., Zhejiang (CN)

(72) Inventors: Xin Xu, Zhejiang (CN); Shaoping Zhou, Zhejiang (CN); Liuchang Lu, Zhejiang (CN)

(73) Assignee: ZHEJIANG JIECANG LINEAR MOTION TECHNOLOGY CO., LTD., Zhejiang (CN)

( * ) Notice: Subject to any disclaimer, the term of this patent is extended or adjusted under 35 U.S.C. 154(b) by 0 days.

(21) Appl. No.: 17/784,112

(22) PCT Filed: Apr. 20, 2021

(86) PCT No.: PCT/CN2021/088244
§ 371 (c)(1),
(2) Date: Jun. 10, 2022

(87) PCT Pub. No.: WO2021/197504
PCT Pub. Date: Oct. 7, 2021

(65) Prior Publication Data

US 2023/0016519 A1 Jan. 19, 2023

(30) Foreign Application Priority Data

Mar. 31, 2020 (CN) ..... 202010243973.3

(51) Int. Cl.
*A47B 9/00* (2006.01)
*A47B 13/08* (2006.01)

(52) U.S. Cl.
CPC ..... *A47B 9/00* (2013.01); *A47B 13/081* (2013.01)

(58) Field of Classification Search
CPC ..... A47B 13/081; A47B 9/00; A47B 9/02; A47B 9/04; A47B 9/06; A47B 9/08;
(Continued)

(56) References Cited

U.S. PATENT DOCUMENTS 3,273,517 A * 9/1966 Amthor, Jr. ..... A47B 27/14 108/2
4,590,865 A * 5/1986 Rutsche ..... A47B 21/06 108/1

(Continued)

FOREIGN PATENT DOCUMENTS

CN 1192033 9/1998
CN 203121491 8/2013

(Continued)

OTHER PUBLICATIONS

"International Search Report (Form PCT/ISA/210) of PCT/CN2021/088244", dated Jul. 21, 2021, with English translation thereof, pp. 1-6.

(Continued)

*Primary Examiner* — Jose V Chen
(74) *Attorney, Agent, or Firm* — JCIPRNET

(57) ABSTRACT

The present disclosure provides a multifunctional hand controller for height-adjustable furniture, and belongs to the technical field of control equipment for electric furniture. The multifunctional hand controller includes a shell. The shell is fixed on the furniture. Switches for controlling the furniture are installed on the shell. The switches include a first switch and a second switch. The first switch is a rotary switch. The rotary switch rotates relative to the shell to generate a first control instruction for controlling the furniture.

9 Claims, 4 Drawing Sheets

(58) Field of Classification Search
CPC .. A47B 9/083; A47B 9/10; A47B 9/12; A47B 9/14; A47B 9/16; A47B 9/18; A47B 9/20; A47B 2009/003; A47B 2009/006; A47B 2009/043; A47B 2009/046; A47B 2009/065; A47B 2009/086; A47B 2009/145; A47B 2009/185
USPC ..... 108/147; 248/188.2, 188.3, 188.4, 188.5
See application file for complete search history.

(56) References Cited

U.S. PATENT DOCUMENTS

| | | | | | |
|---|---|---|---|---|---|
| 4,593,874 | A * | 6/1986 | Dunagan | A47B 9/04 | 248/188.4 |
| 4,714,025 | A * | 12/1987 | Wallin | A47B 9/00 | 340/870.38 |
| 6,220,185 | B1 * | 4/2001 | Pontoppidan | A47B 9/20 | 108/147 |
| 6,595,144 | B1 * | 7/2003 | Doyle | A47B 9/00 | 248/188.4 |
| 7,743,716 | B1 * | 6/2010 | Burka | A47B 9/12 | 248/162.1 |
| 2001/0037751 | A1 * | 11/2001 | Agee | A47B 9/12 | 108/147 |
| 2002/0003081 | A1 * | 1/2002 | Kawase | H01H 25/065 | 200/6 A |
| 2009/0078167 | A1 * | 3/2009 | Ellegaard | A47B 97/00 | 108/147 |
| 2014/0103174 | A1 * | 4/2014 | Koder | A47B 9/20 | 248/188.5 |

FOREIGN PATENT DOCUMENTS

| | | | | |
|---|---|---|---|---|
| CN | 107170621 | | 9/2017 | |
| CN | 107170621 | A * | 9/2017 | |
| CN | 107942741 | | 4/2018 | |
| CN | 107942741 | A * | 4/2018 | B66F 11/00 |
| CN | 209947785 | | 1/2020 | |
| CN | 111449414 | | 7/2020 | |
| CN | 212280390 | | 1/2021 | |
| EP | 0928579 | | 7/1999 | |
| EP | 0928579 | A2 * | 11/1999 | |
| WO | 2019183821 | | 10/2019 | |

OTHER PUBLICATIONS

"Search Report of Europe Counterpart Application", dated Jul. 24, 2023, pp. 1-8.

* cited by examiner

MULTIFUNCTIONAL HAND CONTROLLER FOR HEIGHT-ADJUSTABLE FURNITURE

CROSS-REFERENCE TO RELATED APPLICATION

This application is a 371 of international application of PCT application serial no. PCT/CN2021/088244, filed on Apr. 20, 2021, which claims the priority benefit of China application no. 202010243973.3, filed on Mar. 31, 2020. The entirety of each of the above-mentioned patent applications is hereby incorporated by reference herein and made a part of this specification.

BACKGROUND

Technical Field

The present disclosure relates to a multifunctional hand controller for height-adjustable furniture, and particularly belongs to the field of control equipment for electric furniture.

Description of Related Art

For traditional control equipment for electric furniture, such as an electric lift table, under the condition that the electric lift table usually has the functions of ascending and descending, several groups of ascending and descending buttons will be correspondingly disposed on control equipment of the lift table. For such operation buttons, a user must clearly see and understand movement directions corresponding to each group of switches during the operation before issuing operating instructions correctly. At present, common problems of control equipment of this kind of furniture are that the operation is not user-friendly enough, and there are also problems such as misoperation. Moreover, if there are more control instructions for the control equipment, it means that there are more buttons. Under the numerous buttons, the possibility of misoperation by an operator will be increased.

SUMMARY

To overcome the defects in the prior art, the present disclosure provides a multifunctional hand controller for height-adjustable furniture, so as to make the operation more user-friendly and convenient.

To solve the above technical problem, the present disclosure adopts the following technical solution:

A multifunctional hand controller for height-adjustable furniture, including a shell, wherein the shell is fixed on the furniture, switches for controlling the furniture are installed on the shell, the switches include a first switch and a second switch, the first switch is a rotary switch, the rotary switch rotates relative to the shell to generate a first control instruction for controlling the furniture, the second switch is a joystick switch, and the joystick switch swings relative to the shell to generate a second control instruction for controlling the furniture.

The present disclosure has the following beneficial effects:

In the present disclosure, the switches for controlling the furniture include the first switch and the second switch, wherein the first switch is the rotary switch, and an operation mode thereof is implemented by relative rotation relative to the shell; the second switch is the joystick switch, and the joystick switch is in the form of a joystick and has certain directivity; the first switch and the second switch adopt two completely different operation modes, and correspondingly control different control instructions; compared with operation modes of traditional button type control equipment, operation modes of control equipment in the present disclosure are classified, so that an operator may perform better identification during the operation, and the possibility of misoperation is reduced; and an operation mode simultaneously using the rotary switch and the joystick switch is a good independent operation mode, and after operation for multiple times, a user may even perform blind operation, that is, without looking at the rotary switch and the joystick switch, the operation may be carried out after direct touch, so that the operation is very convenient, and the complicated operation of the traditional control equipment that needs the user to look at the buttons and then press them is eliminated.

Preferably, a bracket is disposed in the shell, the rotary switch is rotatably connected with the bracket, the joystick switch is connected with a positioner, and the positioner is installed on the bracket.

Preferably, a torsion spring for resetting the rotary switch is disposed between the rotary switch and the bracket.

Preferably, the torsion spring includes a main body portion and at least one pin extending from the main body portion, the main body portion is installed on the bracket, and a limit rib in contact with the pins are disposed on an inner wall of the rotary switch.

Preferably, the torsion spring includes two pins, the bracket is provided with a limit column, the two pins are respectively located at two sides of the limit column, and two ends of the two pins are clamped at the two sides of the limit rib.

Preferably, the multifunctional hand controller includes a printed circuit board (PCB), at least one trigger switch that triggers the first control instruction is disposed on the printed circuit board, the limit rib is configured to abut against the trigger switch, and the positioner is installed on the printed circuit board.

Preferably, the rotating rotary switch is a rotary body, an end of the rotary body is provided with a through hole, and the joystick switch extends from the inside of the rotary body to the outside of the rotary body via the through hole.

Preferably, the height-adjustable furniture is a lift table, the lift table includes a table frame, a table board, and a turning motor, the table board is driven by the turning motor to turn over relative to the table frame, and one of the first control instruction and the second control instruction is a lifting instruction for controlling the ascending and descending of the lift table, and the other of the first control instruction and the second control instruction is a turning instruction for controlling the table board to be turned Preferably, the lift table further comprises a moving motor, the table board is driven by the moving motor to horizontally move relative to the table frame, the joystick switch is connected with a positioner, swing directions of the positioner relative to the shell include a first swing direction and a second swing direction, the joystick switch swings relative to the shell in the first swing direction to generate the second control instruction for controlling the furniture, the joystick switch swings relative to the shell in the second swing direction to generate a third control instruction for controlling the furniture, and the third control instruction is configured to control the table board to move.

Preferably, the height-adjustable furniture is a lift table, the lift table comprises a table frame, a table board and a moving motor, the table board is driven by the moving motor to horizontally move relative to the table frame, and one of the first control instruction and the second control instruction is a lifting instruction for controlling the lift table to ascend and descend, and the other of the first control instruction and the second control instruction is a moving instruction for controlling the table board to move.

These features and advantages of the present disclosure will be disclosed in detail in the specific embodiments and accompanying drawings below.

BRIEF DESCRIPTION OF THE DRAWINGS

The present disclosure is further described below with reference to the accompanying drawings.

DESCRIPTION OF THE EMBODIMENTS

Figure 1:
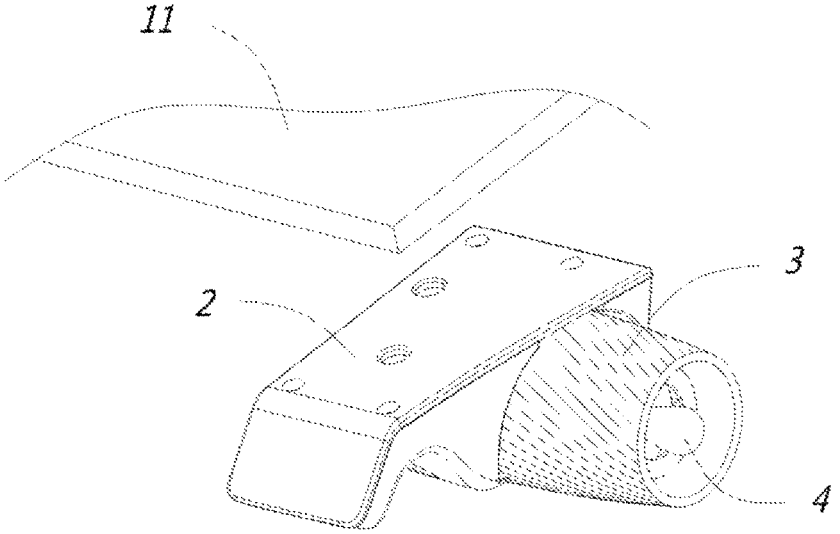
FIG. 1 is a schematic installation diagram of a hand controller and a table board according to an embodiment 1 of the present disclosure.
Figure 2:
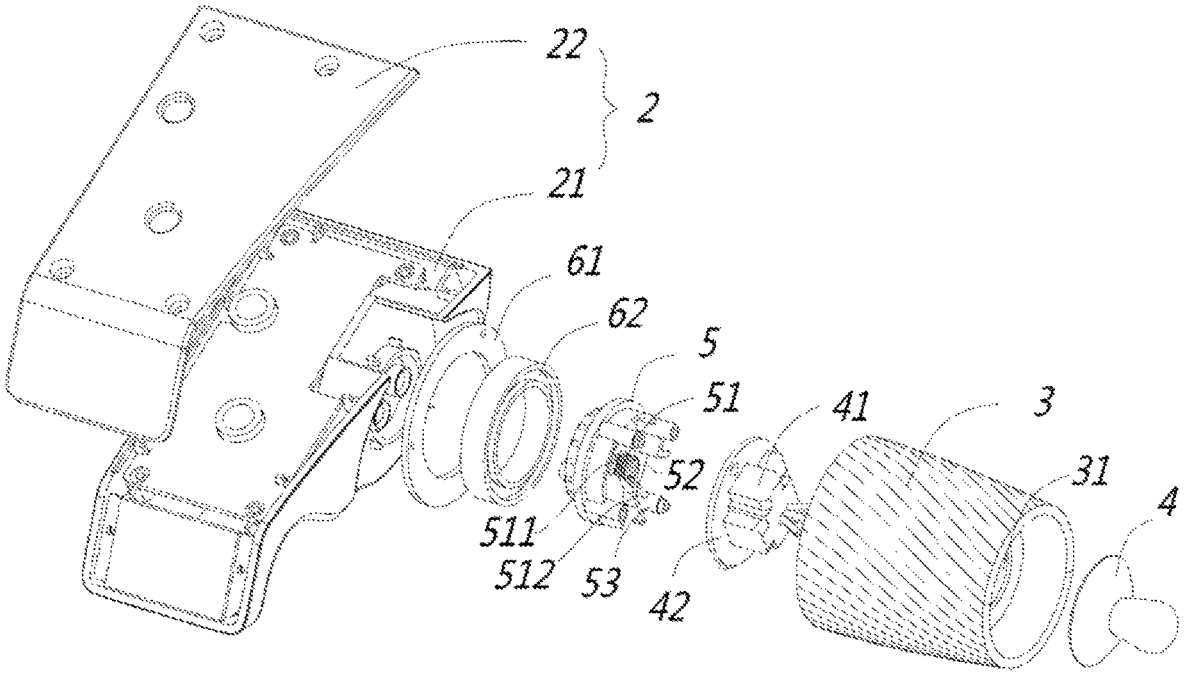
FIG. 2 is a first exploded schematic diagram of the hand controller according to the embodiment 1 of the present disclosure.

The technical solution of the embodiments of the present invention is explained and described below with reference to the accompanying drawings of the embodiments of the present disclosure, but the following embodiments are merely the preferred embodiments of the present disclosure, not all. Other embodiments obtained by those skilled in the art based on the embodiments in the present disclosure without creative efforts all fall within the scope of protection of the present disclosure.

In the following description, the orientations or positional relationships indicated by the terms such as "inner", "outer", "upper", "lower", "left", "right", etc. are merely for the convenience of describing the embodiments and simplifying the description, and are not intended to indicate or imply that the referred devices or elements must have particular orientations and are constructed and operated in the particular orientations. Therefore, they should not be understood as limitations to the present disclosure.

Embodiment 1

As shown in FIG. 1 to FIG. 7, a multifunctional hand controller for height-adjustable furniture is provided. The height-adjustable furniture in this embodiment is preferably an electric lift table. The electric lift table generally includes a table frame 11 and a table board 12, wherein an electric lift column 13 is connected to a lower portion of the table frame 11. The hand controller provided by this embodiment includes a shell 2, the shell 2 is fixed on the electric lift table, the shell 2 generally includes a lower shell 21 and an upper cover plate 22, the upper cover plate 22 is installed on the table frame 11 or the table board 12, switches for controlling the furniture are installed on the shell 2, the switches include a first switch and a second switch, the first switch is a rotary switch 3, the rotary switch 3 rotates relative to the shell 2 to generate a first control instruction for controlling the electric lift table, the second switch is a joystick switch, and the joystick switch 4 swings relative to the shell 2 to generate a second control instruction for controlling the electric lift table.

In this embodiment, the switches for controlling the electric lift table include the first switch and the second switch, wherein the first switch is the rotary switch 3, and an operation mode thereof is implemented by relative rotation relative to the shell 2; the second switch is the joystick switch 4, and the joystick switch 4 is in the form of a joystick and has certain directivity; the first switch and the second switch adopt two completely different operation modes, and correspondingly control different control instructions; compared with operation modes of traditional button type control equipment, operation modes of control equipment in the present disclosure are classified, so that an operator may perform better identification during the operation, and the possibility of misoperation is reduced; and an operation mode simultaneously using the rotary switch 3 and the joystick switch 4 is a good independent operation mode, and after operation for multiple times, a user may even perform blind operation, that is, without looking at the rotary switch 3 and the joystick switch 4, the operation may be carried out after direct touch, so that the operation is very convenient, and the complicated operation of the traditional control equipment that needs the user to look at the buttons and then press them is eliminated.

To make an internal structure of the hand controller simpler and more compact, a bracket 5 is disposed in the shell 2, the rotary switch 3 is rotatably connected with the bracket 5, the joystick switch 4 is connected with a positioner 41, and the positioner 41 is installed on the bracket 5. The advantage of such design is that the bracket 5 serves as installation bases of the rotary switch 3 and the joystick switch 4 at the same time, that is, it serves as not only the base of the rotary switch 3, but the base of the joystick switch 4, so that there are fewer parts, and an internal space of the hand controller may be simplified.

In addition, to ensure that the rotary switch 3 may be reset to an initial position after being rotated, a torsion spring 51 for resetting the rotary switch 3 is disposed between the rotary switch 3 and the bracket 5.

Figure 3:
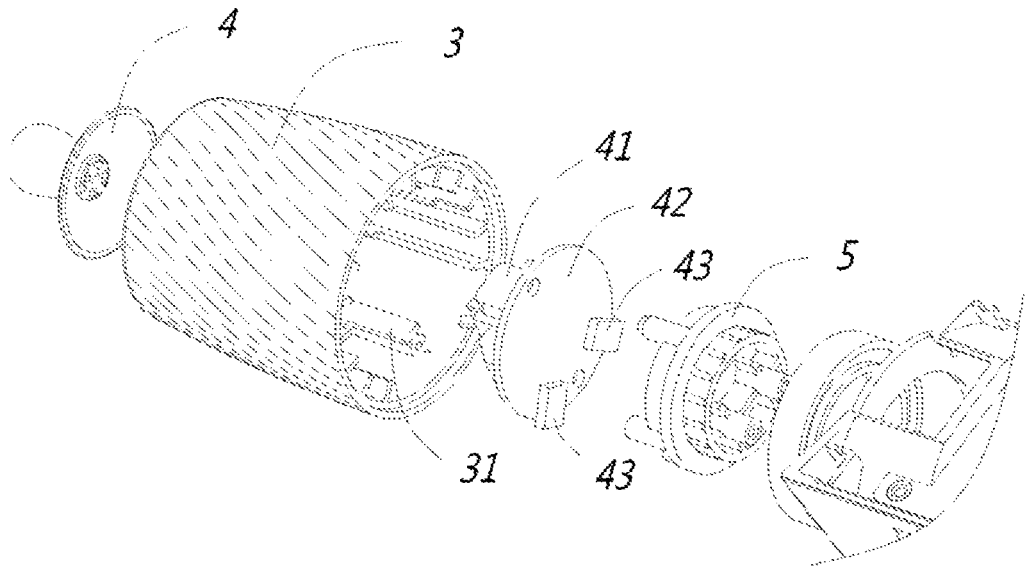
FIG. 3 is a second exploded schematic diagram of the hand controller according to the embodiment 1 of the present disclosure.
Figure 6:
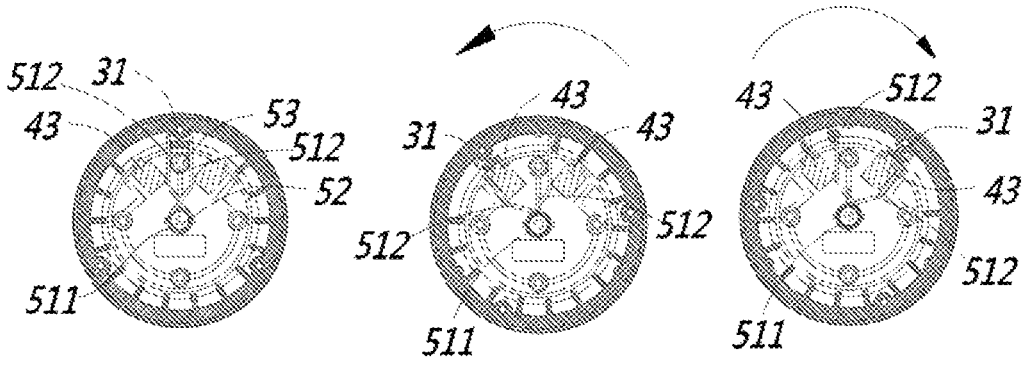
FIG. 6 is a schematic diagram of internal structures corresponding to the three operating states of the rotary switch according to the embodiment 1 of the present disclosure.
Figure 7:
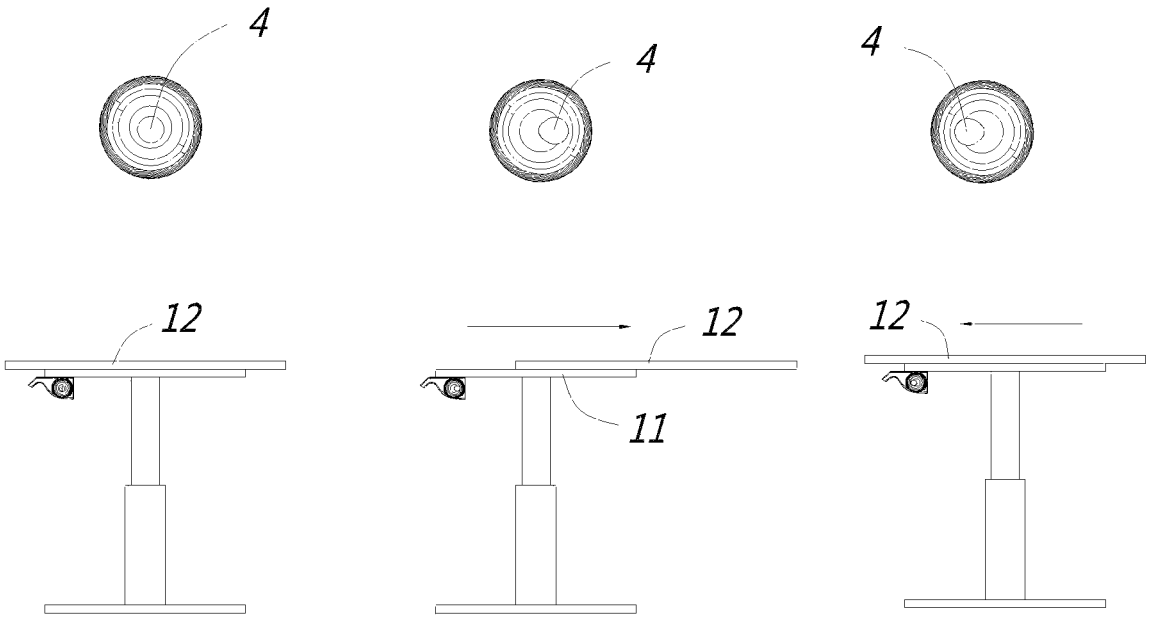
FIG. 7 is a schematic diagram of movements of the lift table corresponding to three operating states of the joystick switch during the swinging in a second swing direction according to the embodiment 1 of the present disclosure.

For a specific structure, the torsion spring 51 includes a main body portion 511 and at least one pin 512 extending from the main body portion 511, the main body portion 511 is a winding portion of the torsion spring 51, the pins 512 are formed by radial extension of the winding portion, the main body portion 511 is installed on the bracket 5, a limit rib 31 in contact with the pins 512 are disposed on an inner wall of the rotary switch 3, and the limit rib 31 may be seen in FIG. 3 and FIG. 6. Since the furniture in this embodiment is height-adjustable, that is, there are two operating instructions of ascending and descending, the torsion spring 51 in this embodiment preferably includes two pins 512, each of the pins 512 may generate a reset force, and the reset forces generated by the two pins 512 are opposite. If the rotary switch 3 is rotated clockwise and counterclockwise, the two pins 512 may generate clockwise and counterclockwise reset forces respectively.

The operation in this embodiment basically cancels a button pressing mode, and a traditional button pressing mode is that dome sheets rebound to initial positions through their own elastic deformation, so that such structure makes the hand controller have requirements for assembly gaps between the dome sheets and button fulcrums during the actual assembly. However, by adopting the solution provided by this embodiment that the current function of the lift table is realized by using the joystick switch and the rotary switch, there is no requirements for assembly gaps between the dome sheets and operating fulcrums during the assembly, and the assembly requirements are lower.

In this embodiment, an installation structure between the bracket 5 and the torsion spring 51 is also improved. In this embodiment, a center column 52 is disposed on the bracket 5, and the main body portion 511 of the torsion spring 51 is positioned and sleeved on the center column 52. In addition, the bracket 5 is provided with a limit column 53, the limit column 53 is located between the center column 52 and the pins 512 of the torsion spring 51 in a radial direction, and the two pins 512 are located at two sides of the limit column 53. For the convenience of description, the pins 512 are temporarily defined as a first pin and a second pin, and the two ends of the two pins 512 are clamped at the two sides of the limit rib 31. When the first pin moves away from the limit column 53 under the condition that the limit rib 31 of the rotary switch 3 is poked clockwise, the second pin abuts against the limit column 53 to generate the counterclockwise reset force. Conversely, when the second pin moves away from the limit column 53 under the condition that the limit rib 31 of the rotary switch 3 is poked counterclockwise, the first pin abuts against the limit column 53 to generate the clockwise reset force.

Moreover, to ensure the compactness of the internal structure, the multifunctional hand controller further includes a printed circuit board (PCB) 42, and the printed circuit board 42 is provided with at least one trigger switch 43 that triggers the first control instruction; the limit rib 31 is configured to abut against the trigger switch 43, equivalently the limit rib 31 in this embodiment has two functions, one of which is configured to poke the pins 512 of the torsion spring 51, and the other is configured to abut against the trigger switch 43; and a schematic diagram of specific trigger may be seen in FIG. 6. Structurally, referring to FIG. 3, in this embodiment, there are preferably two trigger switches 43 arranged on an inner side of the PCB 42, and the positioner 41 is preferably installed on an outer side of the PCB 42, that is, in this embodiment, electric control of the rotary switch 3 and electric control of the joystick switch 4 are both integrated on the same PCB 42, so that there are fewer parts and the rationality of the internal space is guaranteed.

The rotary switch 3 in this embodiment is preferably of a rotary body structure, and the entire rotary switch 3 is sleeved on the bracket 5. In order to make the rotary switch 3 more stable when rotating relative to the shell 2, a gasket 61 is disposed between the rotary switch 3 and the shell 2 in the direction of the center of rotation of the rotary switch 3. The gasket may be disposed to limit an axial direction of a bearing 62, and the bearing 62 is mainly in contact with the gasket 61 when it rotates to prevent the shell 2 from being worn too much. Meanwhile, the disposal of the gasket 61 also helps to reduce a gap between the rotary switch 3 and the shell 2 as well as the shaking degree of the rotary switch 3 during the rotation, thereby indirectly protecting some easy-to-loose parts.

To make frictional resistance of the rotary switch 3 smaller during the rotation, the bearing 62 is further disposed between the rotary switch 3 and the bracket 5 in this embodiment, which may make the user have a better hand feel when rotating the rotary switch 3.

For the rotary switch 3, preferably a through hole 311 is formed in an end of a rotary body, and the joystick switch 4 extends from the inside of the rotary body to the outside of the rotary body through the through hole 311. For such structural design, the whole hand controller will not waste space in structure, and the size is relatively compact and small. The rotary switch 3 and the joystick switch 4 are well combined together, and the positioner 41 is just located between the end of the rotary body and the bracket 5.

Figure 4:
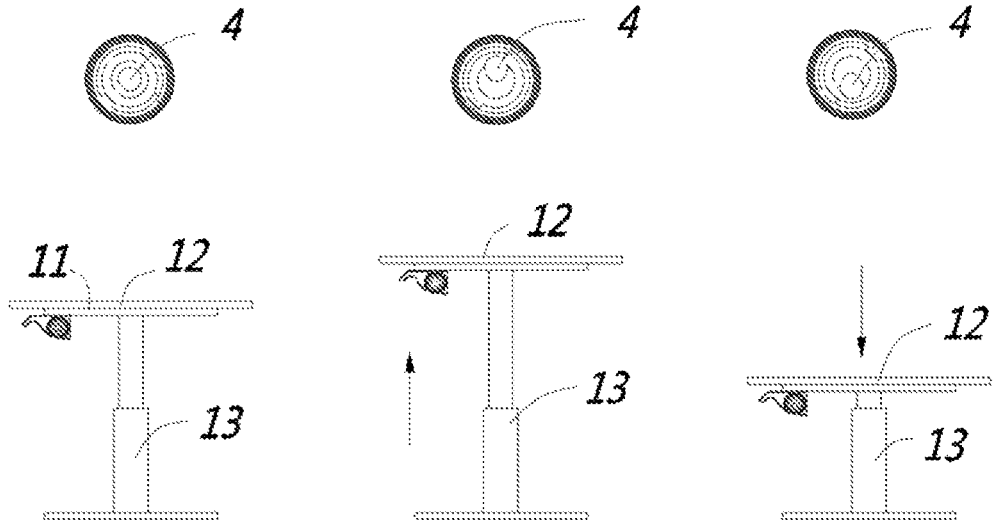
FIG. 4 is a schematic diagram of movements of a lift table corresponding to three operating states of a joystick switch during the swinging in a first swing direction according to the embodiment 1 of the present disclosure.
Figure 5:
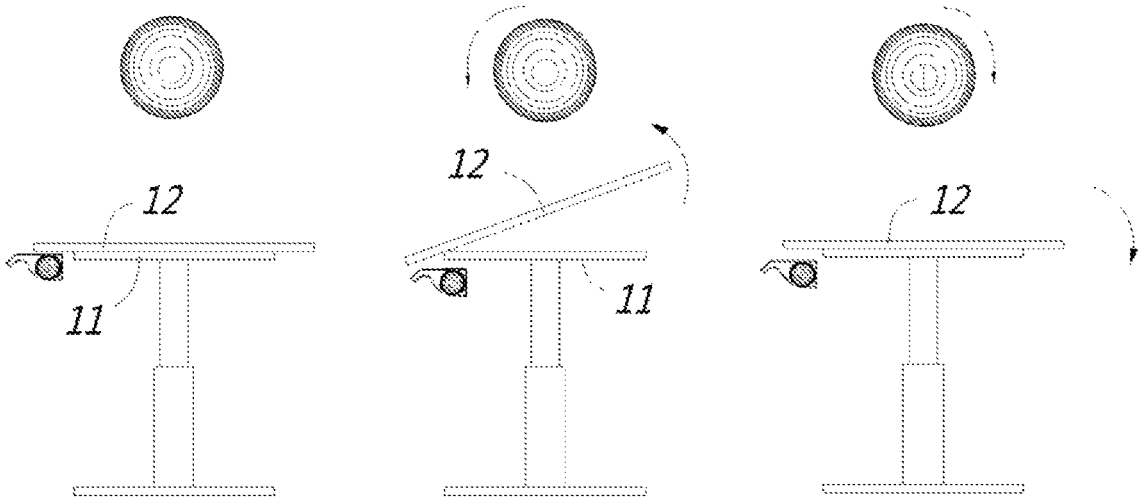
FIG. 5 is a schematic diagram of movements of the lift table corresponding to three operating states of a rotary switch according to the embodiment 1 of the present disclosure.

As mentioned above, the height-adjustable furniture in this embodiment is the electric lift table, the electric lift table is preferably provided with the turnable table board 12, the table board 12 is also driven by a motor to be turned, and the motor may be temporarily defined as a turning motor. The first control instruction and the second control instruction generated by the rotary switch 3 and the joystick switch 4 in this embodiment may respectively correspond to a lifting instruction of the lift table and a turning instruction of the table board 12, or the rotary switch 3 corresponds to the lifting instruction, and the joystick switch 4 corresponds to the turning instruction. Of course, in other embodiments, the rotary switch 3 may also correspond to the turning instruction, and the joystick switch 4 corresponds to the lifting instruction. In this embodiment, preferably that the joystick switch 4 corresponds to the lifting instruction and the rotary switch 3 corresponds to the turning instruction is taken as an example:

As shown in FIG. 4, the joystick switch 4 swings up and down. When it swings up, the lift table ascends, and when it swings down, the lift table descends. Such design is more in line with an operation logic of the user. As shown in FIG. 5, the rotary switch 3 is turned up when rotating counterclockwise, and is turned down when rotating clockwise. In such design, an operation direction of the hand controller is consistent with a movement direction of the table board, and a movement direction of the electric lift table is vividly combined with an actual operation direction. Of course, specific swing direction and rotation direction may be simply changed.

Furthermore, to add the function of the lift table, the table board 12 of the lift table in this embodiment may still move forwards and backwards, and the table board 12 is driven by a moving motor to move. In this embodiment, swing directions of the positioner 41 relative to the shell 2 include a first swing direction and a second swing direction, the first swing direction is the above-mentioned direction of swinging up and down, and the second swing direction is the direction of swinging horizontally. As mentioned above, the first swing direction is configured to generate the lifting instruction, and the second swing direction is configured to generate a horizontal movement instruction. Preferably, during the rightward swing, the table board 12 is triggered to move backwards, and during the leftward swing, the table board 12 is triggered to move forwards, which may be seen in FIG. 7.

Embodiment 2

A difference between this embodiment and the embodiment 1 is that a table board in this embodiment may not have a turning function, that is, a positioner connected with a joystick switch only generates a movement instruction that drives the table board to horizontally move. Specific operation is as follows:

A rotary switch has the same operation mode as the rotary switch in the embodiment 1, rotates clockwise to drive the table board to ascend, and rotates counterclockwise to drive the table board 12 to descend.

The joystick switch swings leftwards to drive the table board to move backwards, and swings rightwards to drive the table board to move forwards.

The above are merely the specific embodiments of the present disclosure, but the scope of protection of the present disclosure is not limited thereto. Those skilled in the art should understand that the present disclosure includes but is not limited to the accompanying drawings and the content described in the above specific embodiments. Any modification that does not depart from the functional and structural principles of the present disclosure fall within the scope of the claims.

What is claimed is:

1. A height-adjustable furniture using multifunctional hand controller comprising a shell, wherein the shell is fixed on the furniture, switches for controlling the furniture are installed on the shell, the switches comprise a first switch and a second switch, the first switch is a rotary switch, the rotary switch rotates relative to the shell to generate a first control instruction for controlling the furniture, the second switch is a joystick switch, and the joystick switch swings relative to the shell to generate a second control instruction for controlling the furniture, wherein the rotary switch is a rotary body, an end of the rotary body is provided with a through hole, and the joystick switch extends from an interior of the rotary body to an exterior outside of the rotary body via the through hole.

2. The height-adjustable furniture using multifunctional hand controller according to claim 1, wherein a bracket is disposed in the shell, the rotary switch is rotatably connected with the bracket, the joystick switch is connected with a positioner, and the positioner is installed on the bracket.

3. The height-adjustable furniture using multifunctional hand controller according to claim 2, wherein a torsion spring for resetting the rotary switch is disposed between the rotary switch and the bracket.

4. The height-adjustable furniture using multifunctional hand controller according to claim 3, wherein the torsion spring comprises a main body portion and at least one pin extending from the main body portion, the main body portion is installed on the bracket, and a limit rib in contact with the pins are disposed on an inner wall of the rotary switch.

5. The height-adjustable furniture using multifunctional hand controller according to claim 4, wherein the torsion spring comprises two pins, the bracket is provided with a limit column, the two pins are respectively located at two sides of the limit column, and two ends of the two pins are clamped at the two sides of the limit rib.

6. The height-adjustable furniture using multifunctional hand controller according to claim 5, wherein the multifunctional hand controller comprises a printed circuit board (PCB), at least one trigger switch that triggers the first control instruction is disposed on the printed circuit board, the limit rib is configured to abut against the trigger switch, and the positioner is installed on the printed circuit board.

7. The height-adjustable furniture using multifunctional hand controller according to claim 1, wherein the height-adjustable furniture is a lift table, the lift table comprises a table frame and a table board, the table board is adapted to turn over relative to the table frame, and one of the first control instruction and the second control instruction is a lifting instruction for controlling the lift table to ascend and descend, and the other of the first control instruction and the second control instruction is a turning instruction for controlling the table board to be turned.

8. The multifunctional hand controller for height-adjustable furniture according to claim 7, wherein the table board is adapted to horizontally move relative to the table frame, the joystick switch is connected with a positioner, swing directions of the positioner relative to the shell comprise a first swing direction and a second swing direction, the joystick switch swings relative to the shell in the first swing direction to generate the second control instruction for controlling the furniture, the joystick switch swings relative to the shell in the second swing direction to generate a third control instruction for controlling the furniture, and the third control instruction is configured to control the table board to move.

9. The height-adjustable furniture using multifunctional hand controller according to claim 1, wherein the height-adjustable furniture is a lift table, the lift table comprises a table frame and a table board, the table board is to adapted to horizontally move relative to the table frame, and one of the first control instruction and the second control instruction is a lifting instruction for controlling the lift table to ascend and descend, and the other of the first control instruction and the second control instruction is a moving instruction for controlling the table board to move.

* * * * *